US007748722B2

(12) United States Patent
Kane

(10) Patent No.: US 7,748,722 B2
(45) Date of Patent: Jul. 6, 2010

(54) FLEXIBLE FOOT-BOARD FOR JUMPING DEVICES

(76) Inventor: Christopher T. Kane, 4500 N. Buckboard Pl., Boise, ID (US) 83713

( * ) Notice: Subject to any disclaimer, the term of this patent is extended or adjusted under 35 U.S.C. 154(b) by 60 days.

(21) Appl. No.: 12/328,198

(22) Filed: Dec. 4, 2008

(65) Prior Publication Data

US 2009/0079148 A1 Mar. 26, 2009

Related U.S. Application Data

(63) Continuation of application No. 10/925,772, filed on Aug. 24, 2004, now abandoned, which is a continuation-in-part of application No. 10/170,829, filed on Jun. 11, 2002, now abandoned.

(51) Int. Cl.
*A63C 5/16* (2006.01)

(52) U.S. Cl. ..... 280/14.22; 280/842

(58) Field of Classification Search ..... 280/14.22; 441/66, 68

See application file for complete search history.

(56) References Cited

U.S. PATENT DOCUMENTS 4,386,915 A * 6/1983 Gilliam ..... 434/253
6,196,558 B1 * 3/2001 Simon ..... 280/14.22
6,461,210 B2 * 10/2002 Lorenzo ..... 441/68
6,942,487 B2 * 9/2005 Corbalis ..... 434/247
2003/0227145 A1 * 12/2003 Kane ..... 280/14.22
2005/0017463 A1 * 1/2005 Kane ..... 280/14.22
2009/0079148 A1 * 3/2009 Kane ..... 280/14.22

* cited by examiner

*Primary Examiner*—Jeffrey J Restifo
(74) *Attorney, Agent, or Firm*—Stephen M. Nipper; Dykas, Shaver & Nipper, LLP

(57) ABSTRACT

A footboard for play, exercise and practice of aerial maneuvers and recreational moves on a jumping device. The footboard is preferably flexible in a variety of directions, but has sufficient firmness so as to allow the board to retain a desired shape. The footboard is attached to the user's feet by a strap system, which holds the user's feet within recesses in the board itself. The footboard is preferably waterproof or water resistant for use on water trampolines, in lakes and swimming pools. Handgrips may be provided at one or more locations of the footboard, which, combined with the flexibility of the board, enhance the moves and style of the practicing foot boarder.

19 Claims, 6 Drawing Sheets

FLEXIBLE FOOT-BOARD FOR JUMPING DEVICES

PRIORITY

This application is a continuation of the utility application entitled Flexible Foot-Board for Jumping Devices filed by Christopher T. Kane on Aug. 24, 2004, with Ser. No. 10/925,772, which itself claimed priority from and was a continuation in part of the utility application entitled Flexible Foot-Board for Jumping Devices filed by Christopher T. Kane on Jun. 11, 2002, with Ser. No. 10/170,829, the disclosures of which are incorporated herein by reference.

BACKGROUND OF THE INVENTION

Field of the invention. The present invention relates generally to sports and recreation activities and more specifically to a footboard for use on a trampoline or other jumping device for fun, exercise and practice of recreational aerobatic maneuvers. Conventionally, various recreational board systems are used to support a standing individual wherein the user's feet rest on or are strapped to the top of the board or boards. Single board systems include the snowboard, skateboard, surfboard, wakeboard, and kite board or single ski. In the past, use of these devices focused on travel along a sidewalk, road or mountain, but recent use of such boards has moved toward stunt and trick uses. Skateboard parks and snowboard/ski jump free-style courses are proliferating and young people especially are enjoying flips, twists, twirls and combination aerial tricks.

This prior art provides several disadvantages however. First, as a practical matter, many of these single board systems require the transportation of a party to a distant locale in order to properly use the desired device. For example, a party who wishes to practice snowboarding must travel to a distant location, purchase a lift ticket, hike, and/or rent a helicopter in order to arrive at a desired location wherein the party can then descend the mountain and navigate the desired jumps in order to achieve an airborne status. This activity can then only be performed when sufficient snow exists. Similarly, a person who relies upon a boat to pull them, to achieve an aerial position, must have the boat present and in the water in order to allow them to be airborne. A party wishing to practice aerial acrobatics based upon these methods are often impeded by the availability of and access to these other items.

Some parties in the prior art have attempted to practice snowboarding or other similar activities upon a trampoline. However, this presents a variety of problems. First, many items which are worn upon a persons feet are heavy and cumbersome and thus a party wearing these devices cannot leap and rise up to a desired height in order to perform many of the desired stunts. Second, many times these items that are worn upon an individual's feet have protrusions or edges that can cut or damage a surface such as a trampoline deck. Third, many times these devices, because of their inflexible and unyielding nature, both limit the number of tricks and maneuvers that can be performed and can also in some instances cause physical damage or injury to a user.

Therefore, what is needed is a flexible practice board that is sufficiently sized and appropriately dimensioned so as to allow a user to perform a variety of aerial moves in a way that provides a challenging, fun and safe workout for the user. What is also needed is a board that is effective for users having various amounts of talent and experience, and that provide fun without danger or discomfort.

Accordingly, it is an object of the invention to provide a flexible practice board that is sufficiently sized and appropriately dimensioned so as to allow a user to perform a variety of aerial moves in a way that provides a challenging, fun and safe workout for the user. Another object of the invention is to provide a board that is effective for users having various amounts of talent and experience, and that provides fun to a user without danger or discomfort.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

The present invention is a flexible footboard device that is appropriately sized and dimensioned so as to allow a user to practice and perform a variety of aerial acrobatic maneuvers, including maneuvers wherein the footboard itself is twisted. The present invention includes a connection system for connecting a portion of the footboard of the present invention to the feet of a user so as to prevent the footboard of the present invention from detaching from its connection with the feet of a user. The device is preferably made of a material that in addition to being flexible, it is also soft and therefore will not damage or scar an underlying surface such as a trampoline deck or other surface positioned on the ground, water or another surface.

In the preferred embodiment the footboard device of the present invention comprises a board that is preferably resilient, soft, has handgrips, and has foot-connectors specially adapted to provide a secure and comfortable fit for the feet. With this footboard of the preferred embodiment, which is soft and flexible and which preferably has at least one handle or hand aperture, the user may perform many forward, aft and lateral board moves and grabs. The flexibility of the board optimizes maneuverability for the foot boarder, which allows additional tricks and movements that would not be possible, or at least not smooth and stylish with a rigid board. Further, the flexibility of the board allows a wide range of tricks and mistakes without damage to the land or water trampoline or other jumping device. Also, preferably, the invented board is made of, or padded by, cushioning material that improves comfort and lessens shock to the feet and ankles during use. This feature lessens the amount of damage both to the parties that use the device as well as preventing damage to the trampoline itself. Furthermore, the board is preferably waterproof or covered in a waterproof casing so that it may be used on a water trampoline.

The preferred board comprises apertures through the board at or near each end of the board, which allows the user to grasp a handle portion of the board with one or both hands. The apertures also allow air to flow through the board, lowering air resistance. The handgrips adapt the footboard for improved moves, control, athleticism and enhanced style during use of the board. Apertures through the board may be combined into a simple one or two aperture grip at each end, or a more complex multiple aperture pattern at each end aimed mainly at customizing and/or decorating the board.

The preferred connection system for securing the footboard to the feet comprises a recessed area for each foot, heel-supports upending from the board behind each heel and broad adjustable straps for each foot. This system tends to constrain the foot from rearward movement off of the board, sideways movement out of the recess and upward movement off of the board. This provides a secure and sure feel for the user, and keeps the footboard properly positioned on the feet even during extreme tricks. Preferably, the heel supports and straps do not extend through the board and are not visible on the bottom side of the board, thus providing a smooth and continuous appearance for the bottom board surface. The preferred bottom surface includes the preferred handgrip apertures extending through the board near each end of the board as the only interruptions in the continuous, flat bottom surface.

For individuals who do not have two feet or legs, have different length legs or have physical disabilities, the invented footboard may be specially adapted for increased comfort and ease of use. For example, the invented footboard may be used, or made, to accommodate only one foot, with the connector system positioned on the board as desired for the balance and comfort of the user. Additional padding, spacers or connector modifications may be made to adapt the footboard for amputees, other individuals who may favor or use only one leg/foot or otherwise physically challenged individuals. The preferred flexible and cushioned soft board is particularly beneficial to such users who may not want a rigid hard board.

Therefore, it may be seen that an object of the invented footboard device is to provide a toy or accessory for trampolines to enhance the fun and options for trampoline jumps. Another object is to provide a footboard that allows practice of snowboarding aerial moves on a trampoline. Another object is to provide exercise and family entertainment by encouraging safe play with a flexible and soft footboard and protective gear, and for backyard trampolines by preferably providing screening, fencing or other guards around the trampoline to prevent falls to the ground.

The purpose of the foregoing Abstract is to enable the United States Patent and Trademark Office and the public generally, and especially the scientists, engineers, and practitioners in the art who are not familiar with patent or legal terms or phraseology, to determine quickly from a cursory inspection, the nature and essence of the technical disclosure of the application. The Abstract is neither intended to define the invention of the application, which is measured by the claims, nor is it intended to be limiting as to the scope of the invention in any way.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive in nature.

DESCRIPTION OF THE PREFERRED EMBODIMENTS

Figure 1:
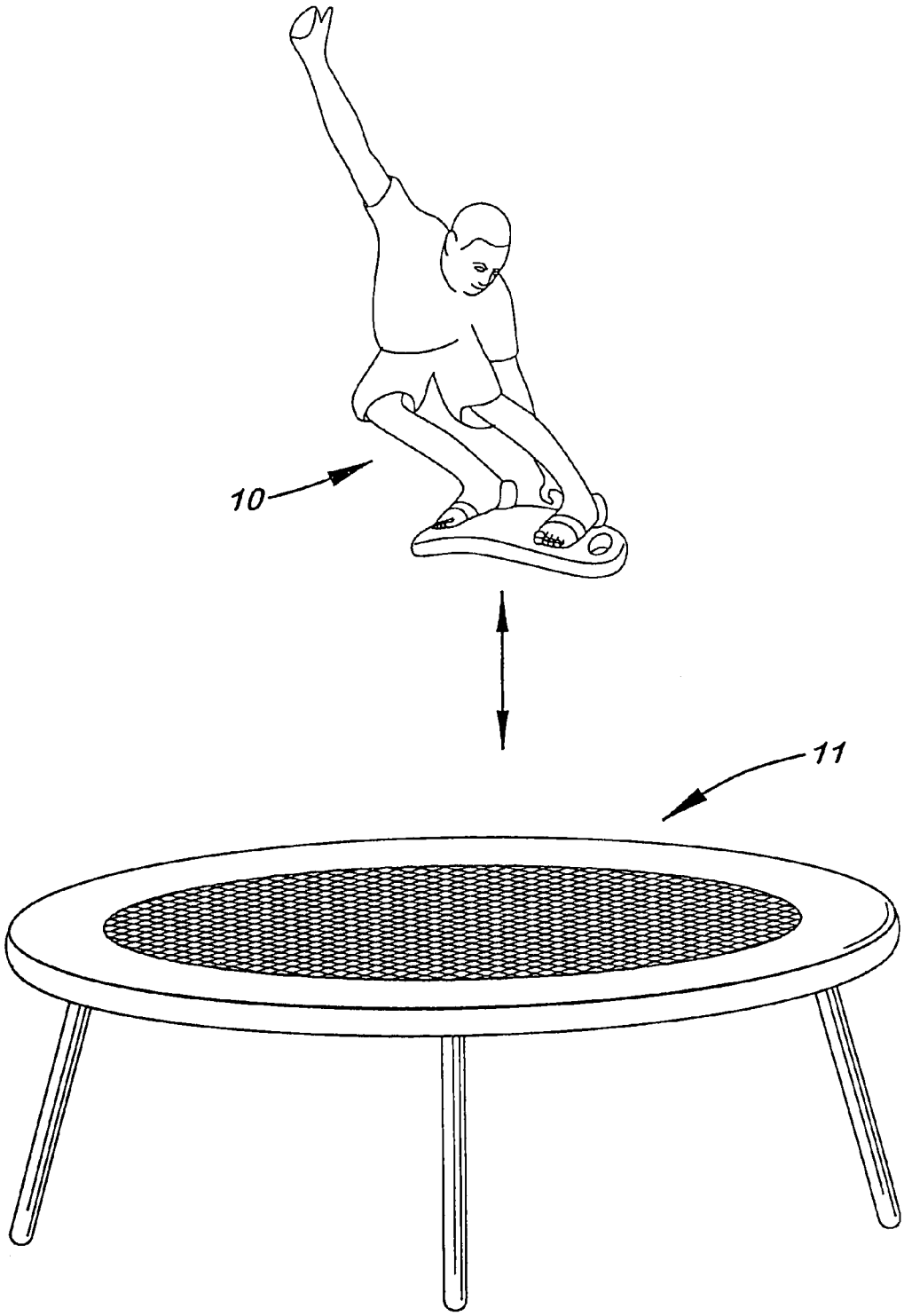
FIG. 1 is a perspective view of one embodiment of the invented footboard apparatus being used by an individual on a land-supported, spring-based trampoline.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

Figure 2:
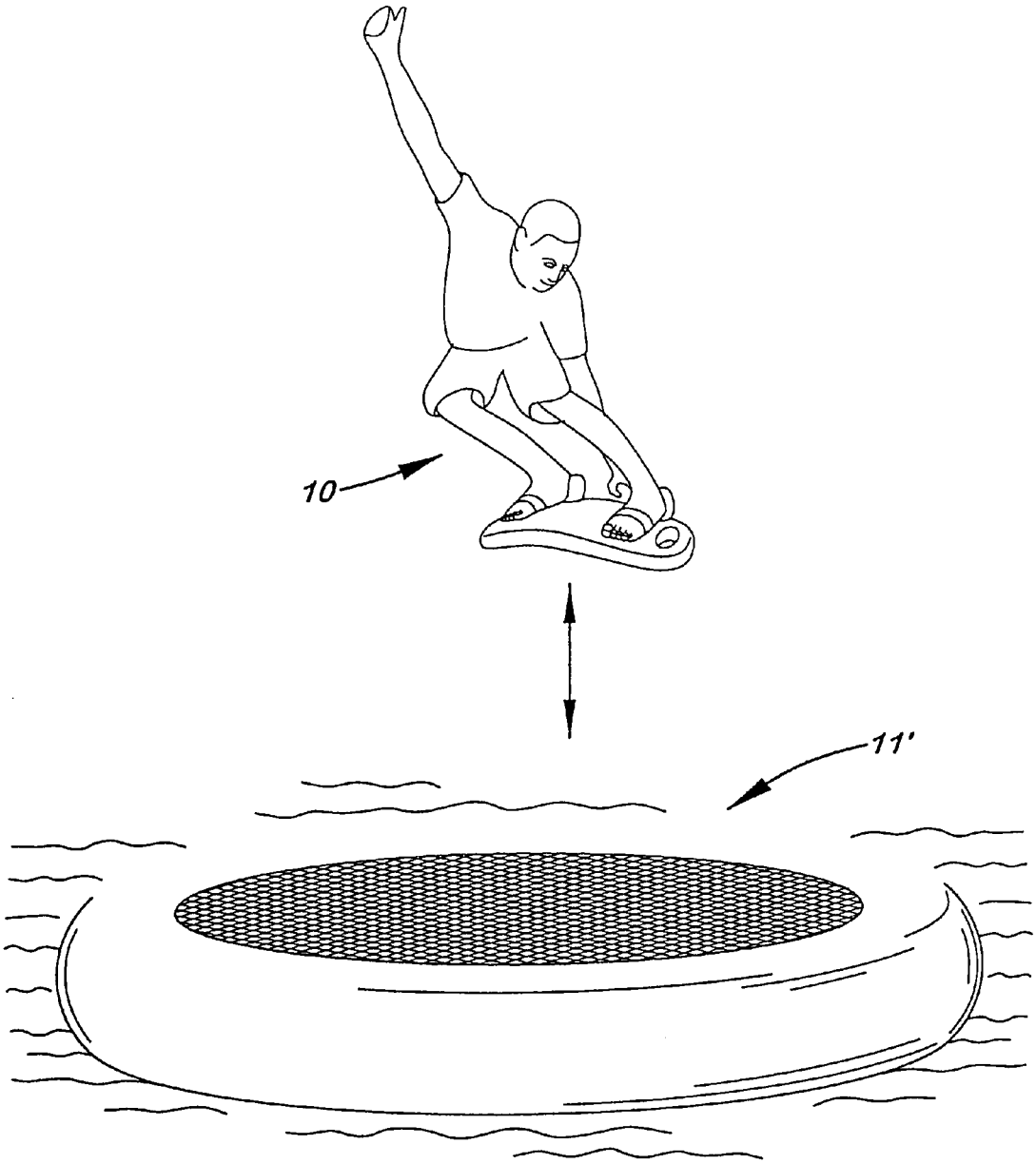
FIG. 2 is a perspective view of the embodiment of FIG. 1 being used on a water trampoline.

Referring now to FIGS. 1-10, there are shown several, but not all, of the various embodiments of the invented footboard apparatus 10. FIGS. 1 and 2 illustrate the use of the board of the present invention in use upon a ground based traditional trampoline 11 and on a water trampoline 11', respectively. While not shown, other jumping, bouncing devices may be well adapted for use with a footboard according to the invention. Examples of such other bouncing devices include, but are not limited to a children's inflatable jumping platform, such as the well-known inflated screened in platforms that are popular at fairs and kid's parties, and that typically take a fanciful shape such as a blowup castle, dragon, clown, rocket ship etc. As is demonstrated by these figures, the present invention is used by a party attaching the invention to their feet and then launching themselves upward by bouncing upon the bouncing or launching device.

Figure 3:
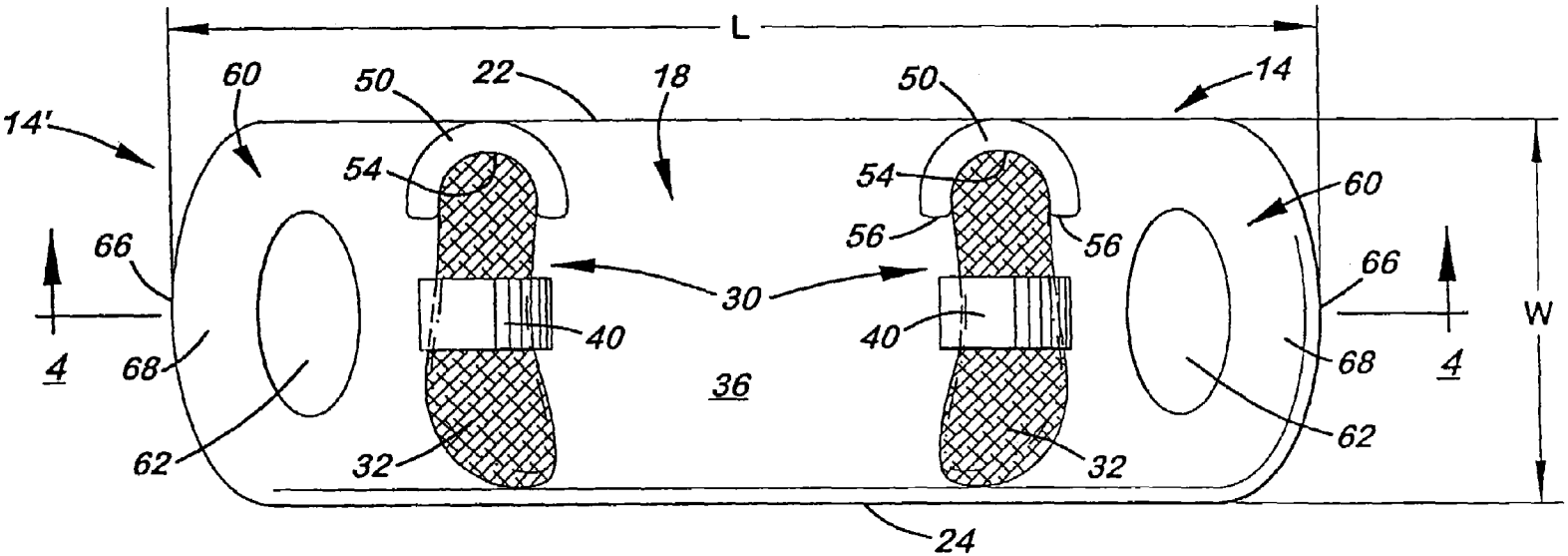
FIG. 3 is a top view of one embodiment of the invented footboard apparatus showing the user's feet in dashed lines, and illustrating one embodiment of a foot connection system and hand grasp apertures.
Figure 4:
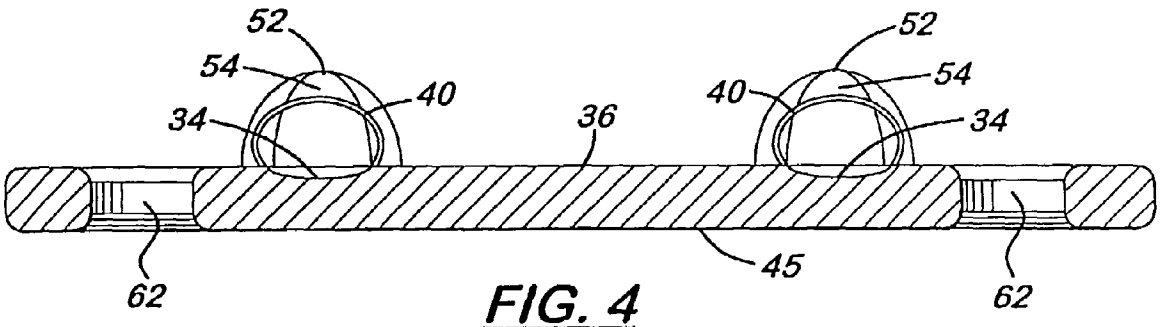
FIG. 4 is a front cross-sectional view of the embodiment of FIG. 3.
Figure 5:
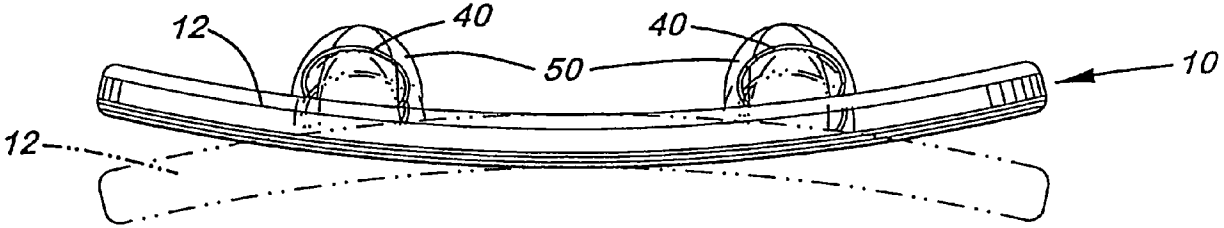
FIG. 5 is a front edge view of the embodiment of FIGS. 3 and 4, with the footboard flexed upward along its longitudinal axis (concave when viewed from above), and with dashed lines illustrating how the footboard may also flex downward (convex).
Figure 7:
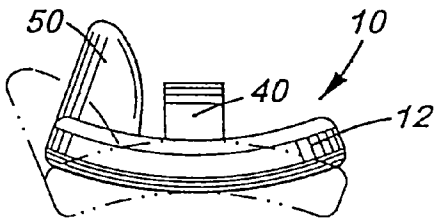
FIG. 7 is a right end view of the embodiment of FIGS. 3-6 with the footboard flexed upward (concave) transversely, and with dashed lines illustrating how the footboard may also flex downward (convex) transversely.
Figure 8A:
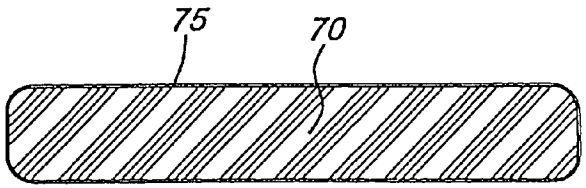
FIG. 8A is a cross-sectional view of a portion of the footboard of FIGS. 3-7, illustrating the interior flexible and cushioning material surrounded by a water resistant or waterproof cover.
Figure 6:
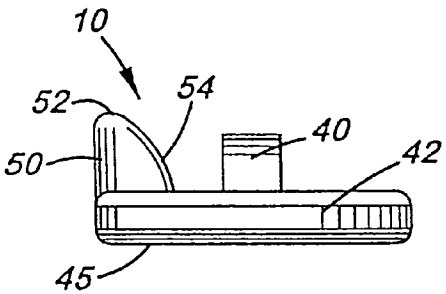
FIG. 6 is a right end view of the embodiment of FIGS. 3-5.
Figure 8B:
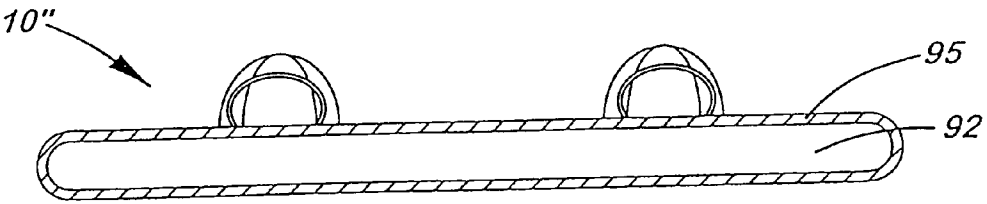
FIG. 8B is a cross-sectional view of an alternative embodiment of the invented footboard, which is an inflatable footboard.
Figure 9:
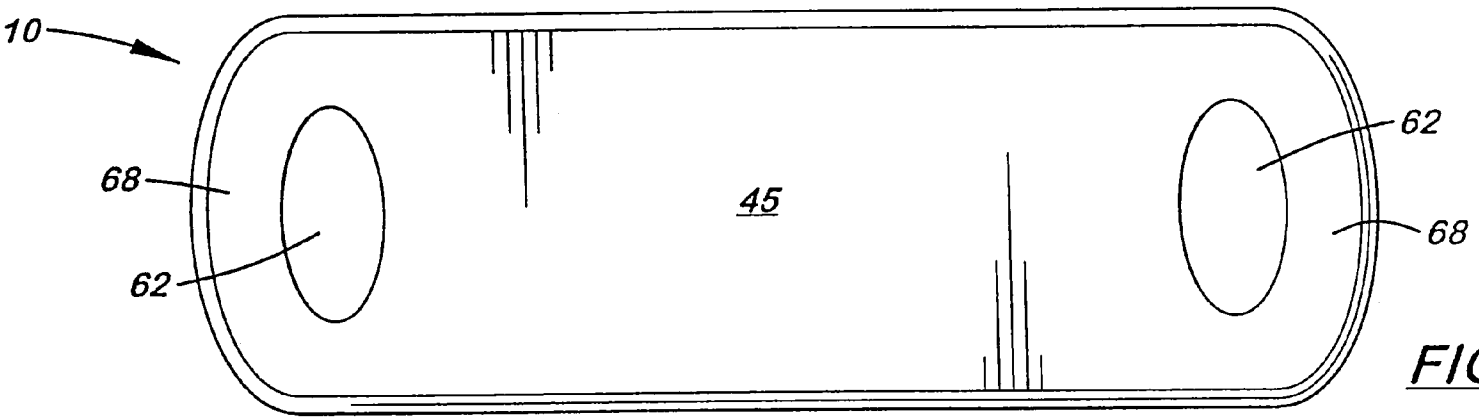
FIG. 9 is a bottom view of the embodiment of FIG. 3, illustrating two hand grasp apertures.
Figure 10:
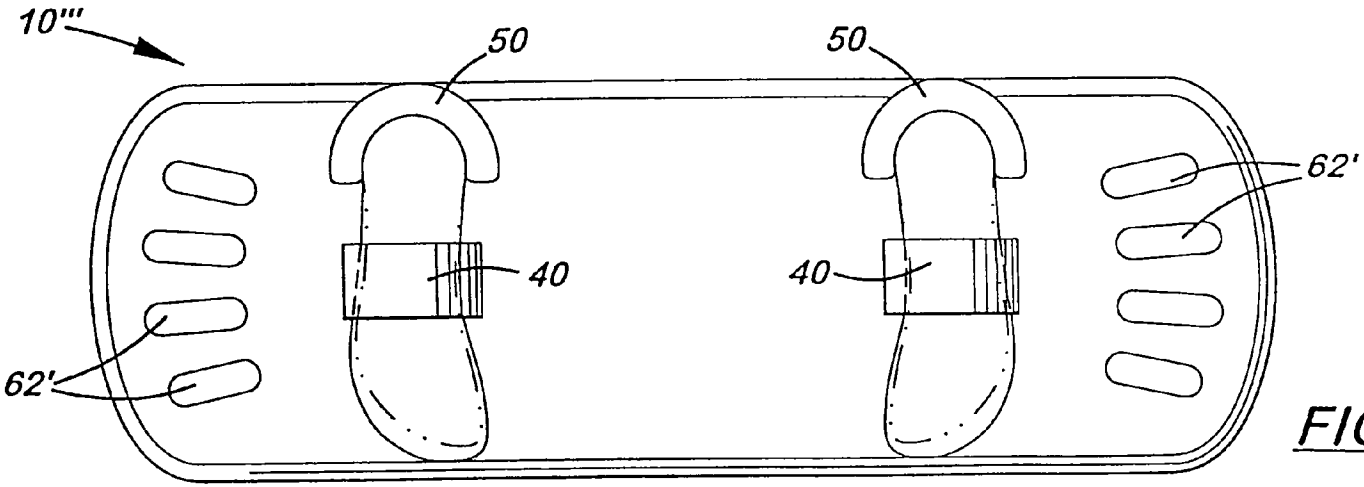
FIG. 10 is a top view of an alternative embodiment of the invented footboard apparatus, including foot connection systems and apertures comprising four slots through each end of the footboard.

FIGS. 3 and 4 show a top plan and a front plan view of the first preferred embodiment of the present invention. These figures show the general configuration of the board and placement of various features of the device including the foot receiving connectors and the associated handgrips of the present invention. FIGS. 5-7 illustrate the preferred flexibility features of the footboard. FIGS. 8A-8B illustrate two of many alternative interior constructions of the footboard. FIG. 9 shows the simple lines of the bottom of the preferred embodiment with two handgrips. FIG. 10 illustrates an embodiment of a footboard with alternative apertures through the ends of the board.

Referring now to FIGS. 3 and 4, the preferred footboard apparatus 10 comprises a board 12 that is elongated and has a longitudinal axis that extends between a left end 14 and a right end 14'. The board is longer (direction L) than it is wide (W), and it preferably is a generally oval or other rounded corner shape. The middle portion 18 of the preferred board is wide enough to accept many sizes of feet, from child sizes to a typical teenager or adult user's foot, so that one board may be a "one size fits all" board. Alternatively, the invented board may be made, for example, in size small, medium, large and extra-large to proportion the board better to individual user's feet and body.

As shown in the outlines in FIGS. 3 and 10, when placed upon a user, the user's feet extend across the middle portion 18 of the board generally transverse to the longitudinal axis. In the preferred embodiment, the user's heel is positioned near the rear edge 22 and the toes extending to near, but not beyond, the front edge 24. Many dimensions may prove effective, including the preferred board 12 that is 2-4 feet long by 12-20 inches wide by 1-3 inches (more preferably 2-3 inches) thick, with oblong or rounded ends 14, 14'. A single footboard in these ranges will work well as the one-size-fits-all board for a variety of individuals with different foot sizes.

The board 12 is connected to the footboarder's feet by a connection system 30 that preferably generally centers the feet longitudinally and transversely on the board. This assists the user in balancing and predicting the affect of each impact on the trampoline. Therefore, the term "central area" and "generally centered" mean generally near the center point of the board, wherein the user has his/her two feet straddling the center point or one foot approximately at the center point, but not necessarily exactly centered.

Less preferably, the invented footboard device 10 may be designed so that the user is not centered on the board, for example, for special effects or preferences. For example, the connection system on an elongated board may be placed so that one end of an elongated board extends significantly farther on one side of the user than the other, or a round or other shape board may be used.

The preferred connection system 30 comprises two spaced apart areas on the board 12 for receiving the two feet, an elastic strap system for retaining the board on the feet and a padded or inflated heel rest system. This combination of preferred features provide an effective, yet safe and easy to use connection between the feet and the board. The preferred connection system has three elements (recess, heel pad, and strap) that are fixed in location on the board. However, the invention may also include connection systems that are movable to suit individual preferences or sizes, for example, by eliminating the recesses and making the heel pad and straps movable to various different anchor points on the board. Also, the strap and heel rest/pad may be combined into a single shoe or binding that may be moveable to various positions on the board or the invention may comprise a simpler connection system, such as a strap only system, that may be moveable to various positions on the board. Such moveable connection systems may attach to various fasteners spaced apart on the board that move the foot positions, for example, farther apart, forward or backward, pointed outward or one foot forward relative to the other foot.

Preferably, each of the foot receiving areas is an elongated recess 32 that is large enough to receive a teenager or adult's foot, and therefore is also large enough to receive a child's foot. For the optional small or medium boards, the board, recesses, heel rest and straps may be down sized to more safely and comfortably fit a child.

In FIG. 3, the recesses 32 are shown as each being the shape of an outline of a foot, but other shapes would be effective as long as all or most of the foot can be received within the recess. Alternatively, a single broad recess for both feet may be used. The preferred recesses are in the range of ¼ to 1 inch deep, and more preferably, about ¼ to ½ inch deep relative to the surrounding top surface. In the preferred board, the recesses extend transversely substantially all the way across the board.

The board is preferably somewhat resilient and flexible, which lessens stress on the feet and ankles and prevents damage to the trampoline. However, the bottom wall 34 of the recesses, and/or the entire board, are preferably firm enough that the user's actions on the board and trampoline transmit force to the outer ends, edges and surfaces of the board and hence, transmit force to the trampoline. Further, when the user stands on the board in the recesses 32, he/she may compress the board a slight amount, but does not sink deep into the board. When the user jumps with the board on the trampoline, the board transmits force between the trampoline and the user. The footboard device may include stiffening material on or in the bottom wall 34 of the recesses to provide an even firmer footing, and the bottom wall 34 may be textured to assist in firm footing for the barefoot or stocking foot user. The recesses 32 assist in preventing lateral movement of the feet, that is, toward either end of the board.

The strap 40 or other foot securement structure that extends over the top of the foot is configured to hold the feet of a user in place. In the preferred embodiment, the device includes a two inch wide heavy-duty polypropylene webbing with a hook and loop closure. Another preferred strap system utilizes two elastic neoprene or rubber straps that are tightened and closed by a hook and loop fastener such as Velcro™. The elastic neoprene is stretchable in at least two directions and is especially comfortable and secure. Alternatively, the straps may be non-elastic and include buckles or fasteners to adjust the fit of the straps 40 on the feet. Optionally, the straps may be a closed toe structure, which is more like a shoe, that covers and retains the entire front of the foot, and the term "strap" or "strap means" may include open toed strap means and closed toed strap means.

The straps 40 may be attached to the board in various ways, but preferably, the straps are anchored to the top of the board or in the middle of the board but do not extend all the way through the board to the bottom surface 45 of the board. This way there is no strap structure on the bottom of the board to catch on anything, and the bottom of the board is a smooth, generally continuous surface without strap holes and without rivets or other fasteners that might damage the trampoline. As one may see in FIG. 4, the preferred embodiment has apertures through the board near the two ends of the board, but preferably no apertures or holes extending all the way through the board in the center area of the board.

At the rear end of each recess 32 is a heel rest 50 that upends from the top surface 36 of the board 12 at or near the rear edge 22. Each heel rest 50 preferably extends up 1 to 5 inches, and more preferably, 2 to 4 inches at its rearmost side 52, and is preferably a semi-cylindrical shape so that its inner surface 54 curves around the user's heel. As shown in FIG. 6, the preferred heel rest 50 has an upper edge that slants downward from its rearmost side 52 to its two front edges 56. This shape tends to "cup" the user's heel, which is often only covered by a sock. The heel rest 50 is preferably a soft, cushioning structure that supports and cushions the back of the heel with little or no chance that the heel or foot might be hurt by hitting back on the heel rest or by coming down hard on the heel rest. Preferably, the heel rest is made of the same material as the board 12, for example, high density closed cell foam, and may be covered with padding and/or a flexible waterproof casing material.

Alternatively, other heel rests may be used such as a generally straight wall about 3 to 4 inches long upending from the board surface 36, but not curving around the heel. The heel rests may be units that are separate from the strap or the heel rest may be incorporated into a single shoe unit that includes both the strap and the heel rest. Still, preferably but not necessarily, the bottom of the "shoe" is recessed below the surrounding top surface of the board.

These and other heel rest shapes may fulfill the objectives of supporting the heel, preventing the foot from sliding rearward off the board and properly orienting the user to the board when putting the board on his/her feet and while jumping. The heel rests help the user keep his/her feet properly positioned, even during extreme jumps and maneuvers, and which gives a feeling of security or sureness when preparing for and executing such maneuvers. In the preferred embodiment the heel rests are made of a flexible material that cushions and flexes when force is applied against them.

Alternatively, connection systems may be used that are not strap based. For example, special socks or boots may be provided to the user that includes hook and loop fasteners, magnets, clips or other attachment means that connect with the cooperative structure on the top surface of the board.

FIG. 4 shows the board in its "resting position" wherein no force is being applied by the user or the trampoline and the board is generally planar and flat. It is not significantly convex or concave in any direction, and preferably does not have edges that are curved upward or downward. Specifically, the left and right ends 14, 14' are preferably not turned up or down. However, the generally flat board 12 is preferably flexible so that the board will bend and curve when significant force is applied to it by the user impacting the board against the trampoline. Thus, the extent and location of bending/curving of the board will depend on what portion hits against the trampoline and what forces the user otherwise applies. For example, the user may grab the board at one or more of the handgrips 60 or one or more of the outer edges of the board, and pull up on that area of the board causing more curvature of the board. By pulling up on a handgrip 60, the user may curve the end of the board up along the side of the adjacent foot for example, and the force of doing so and the resultant shape of the board may affect the aerial moves he/she is performing, or at least affect the look and style of the moves.

The handgrips 60, as shown in FIGS. 3, 4 and 9 are formed by the presence of a generally oval aperture 62 all the way through the board 12 near each end (14, 14'). Between the aperture 60 and the end outer perimeter edge 66 is a handle portion 68 of the board. Part of a user's hand may fit through the aperture for grasping the board at the handle portion 68. Typically, the user grasps the curved handle portion 68 by placing the thumb through the aperture 62 and wrapping the fingers around the end outer perimeter edge 66.

Alternatively, other shapes or types of handgrips may be used in place of the simple oval aperture style grip. For example, a loop or other strap may be on the top surface 36 or extending from the perimeter edge 66 near the ends 14, 14', and sized for convenient grasping by the user, rather than having a handgrip aperture at the ends. Also, more than one aperture may be placed near one or both ends (14, 14') of the board. In FIG. 10, there is shown a footboard embodiment 10''' of a board according to the invention that has four small apertures 62' that fan out on each end. Such multiple, small apertures do not serve very well as handgrips because they are too small to safely allow a thumb or fingers to be inserted, but, instead serve as a means to lessen air resistance or to personalize and decorate the board.

The flexible board is preferably flexible enough to flex along its longitudinal axis (FIG. 5) and also along its transverse axis (FIG. 7), which lends greatly to the options for interesting tricks and artistic effects for each individual user. Preferably, but not necessarily, the board is flexible enough to bend into at least a 70-degree arc, and more preferably, a 90 to 135 degree arc. With such a flexible board, the user has a great range of movement in the air and on the trampoline, and can shift and control his/her weight and movement in different ways. Therefore, the invented footboard is a more "fluid" device than would be a rigid board. While lending some freedom of movement to the foot boarder, it still provides connection of the two feet together and provides an interesting platform for the feet as the user jumps and flips. Certainly, the board constrains the feet and legs more than completely free feet because the goal of the device is to provide some constraint and a particular format of jumping with the feet generally together. The board constrains the feet to an extent that allows the user to simulate tricks done with other boards, such as a snowboard or skateboard.

The material that is used must have the ability to flex and twist when acted upon by the typical forces that are encountered by a user during use while also having sufficient retentive properties so as to retain the desired shape. In the preferred embodiment of the invention, the footboard is made of a cross-linked polyethylene foam such as those foams sold under the trademarks VOLARA®, VOLEXTRA® and MINICEL®. However, a variety of other types of material may also be utilized. These would include various types of closed cell sponge rubber and PVC (polyvinyl chloride), and other types of compressed flexible polyester or polyurethane types of foams. These include the material sold under the trade name SIF FELT®. In some circumstances the foam that is utilized must be provided with a coating or skin to cover the open foam or the foam must be treated or otherwise covered to provide increased integrity to the overall structure of the device.

In the preferred embodiment, the body of the board is made from a cross-linked polyethylene foam that that has a sufficiently high resistance to compression so as to provide a desired level of rigidity while still possessing the ability to be flexible when subjected to the various forces encountered during its use. This has been found to exist when the foam that is used in the device has a foam density between 5 and 15 pounds per cubic foot and a 25% load compression quality between 5 and 25 psi (pounds per square inch). While these ranges of activity have been shown and described, it is to be distinctly understood that the invention is not limited thereto but may be variously embodied to afford the necessities required by an individual user.

The board 12 may be made of various materials with high density, closed-cell foam being the preferred, but not the only material. Preferred materials are of the type used in foam flotation devices or wrestling mats, specifically Wondermat™ by Popcorn International, or memory foam such as Visco Elastic Memory Foam Latex with an overlayment of padding and waterproof covering. Especially preferred materials are closed-cell, mini-cell foams, such as the type used in kayak liners and canoe yoke padding. Various open or closed cell foams may be used, but closed cell foams are preferred, such as closed-cell polyethylene, with the appropriate densities being chosen to give the preferred firm, but flexible and padded effect on the bouncing/jumping device. In the case of open-cell foam, a waterproof skin or cover is preferred to adapt the board for water use and to keep the board clean. The preferred foam layer(s) have the flexibility and softness features desired for the board, but optionally, additional padding or cushioning layers may be added to the outside of the board.

The closed-cell foam is generally waterproof, or at least water resistant, so that the board device 10 may be used on a water trampoline and so that the board 12 does not tend to pick up dirt or other material. In the case of most closed-cell foams, there will not be a need for a cover and the closed-cell foam may be colored, marked with indicia or otherwise decorated. Optionally, as shown in FIG. 8A, the interior of the board 12 may be a plate 70 of open-celled foam or other resilient material(s), which may be covered on all sides and edges with a flexible plastic casing 75. The casing 75 improves water resistance and/or provides an easily decorated surface for color, indicia or other markings. This configuration also provides a board that is buoyant.

The preferred board, which is about 3 feet long by 14 inches wide by 3 inches thick, may accommodate many different individuals, ages 6 and up. However, to accommodate various sizes/weights of individuals and various preferences for flexibility vs. firmness, the dimensions and materials of the board may be modified to produce different "tunings" for the board, such as a relatively firm board that is slightly flexible, a medium board and a maximum flexibility board. A medium flexibility board is illustrated by the high-density closed-cell foam plate in FIG. 8A, wherein the single closed-cell foam plate provides a desirable blend of softness and flexibility without a "floppy" effect.

An example of manufacture of the footboard follows:

1. Cut out two board plates and two heel rests from high-density foam plate. In one foam plate (the top plate), provide through holes for straps.
2. Cut out fabric casing from vinyl, leather, canvas, denim, faux fur or other casing material, for example, in two sheets that are the general shape of the board but 1.5 inches larger all the way around the perimeter to account for the thickness of the board and for seams.
3. Cut out casing fabric to cover heel rests.
4. Sew four buttonholes to receive straps, two on each piece of casing material.
5. Sew and cover heel rests.
6. Sew, glue or otherwise attach heel rests in place.
7. Sew fabric casing for board by conventional sewing/upholstery techniques, leaving an opening for placement over the board.
8. Layer the flexible plastic core in between the two foam layers, with elastic neoprene or rubber and Velcro™ straps threaded through the top foam and core insert. Insert layered foam and core insert into casing and thread straps through casing (straps 40' shown with buckles in FIG. 8B). This way the straps are anchored by looping through the touch, tear-resistant plastic plate.
9. Provide zipper, hook and loop fasteners or other closure means for closing casing around foam.

For mass production, die cut foam construction or foam mold injection construction may be cost effective. Also, mold compression production used for flotation devices may be cost effective. Also, plastic-molding techniques may be used to create an inflatable rubber, latex or vinyl casing that may be filled with air to the desired firmness. In another preferred embodiment, the device is assembled by laminating layers of foam one upon the other so as to achieve a board having a desired thickness, resiliency and strength. Such a device could also include a fabric cover over the bottom of the board that is glued or otherwise permanently attached to the bottom of the board.

FIG. 8B illustrates a footboard 10" according to the invention that is inflated with gas (preferably air) rather than being made of foam or fabric layers. This is accomplished by providing a tough outer casing 95 that has an interior space for receiving air or other gas. The footboard 10" is fully inflated to an extent that it serves as a firm bouncing platform on the jumping device. An inflated footboard according to the invention may also comprise hand holds, either formed by the footboard "skin" being molded to have aperture style hand holds at each end, or by hand hold straps or other handles being attached to the outer surface of the skin.

On the extreme end of maximum flexibility is a board made of tough, thick fabric material or a tough material on a frame. For example, a nylon material reinforced with a plastic frame and batons may be used wherein such a fabric material may be similar to kite, sail or tent material. Such a maximum flexibility board may be effective for some individuals, but most are expected to prefer the more substantial thicker and less-flexible plastic foam embodiments of the invention. On the extreme end of rigidity is a wooden, plastic or other rigid board, but such rigid boards are considered too rigid, too shocking and too damaging to the trampoline and are preferably not used.

Figure 11:
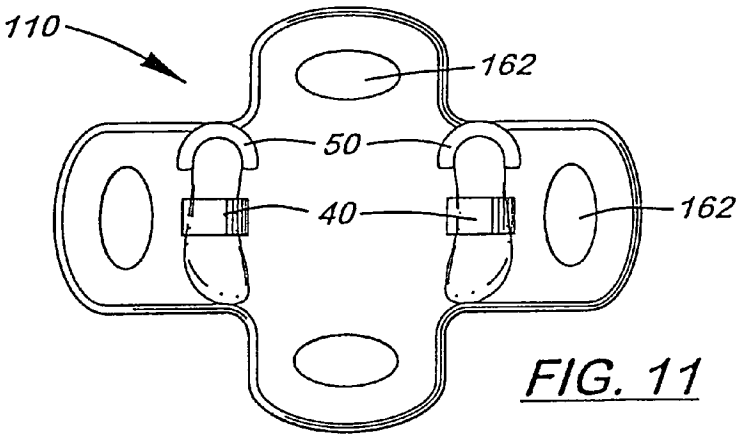
FIG. 11 is a top plan view of another embodiment of the invention.

Alternative shapes may be beneficial or fun for users. FIG. 11 illustrates a cross-shaped footboard 110 that has the connection system placed between right and left ends, and also has front and back protruding portions generally in front of and in back of the user's feet. All four of the "ends" (the right, left, front and back) preferably have hand apertures 162 for providing handle portions that the user may grab.

Figure 12:
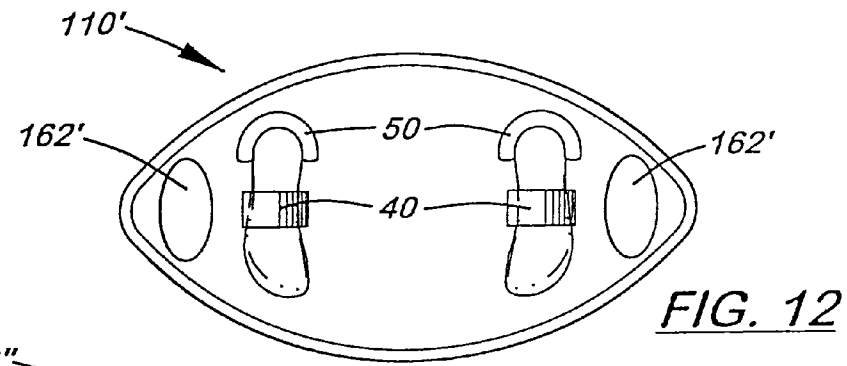
FIG. 12 is a top plan view of another embodiment of the invention.

FIG. 12 illustrates an oval or oblate shaped footboard 110' according to the invention, which may have generally pointed, but not injurious, pointed ends. This board has right and left end apertures 162', which are easily grabbed by the user as they are preferably close to the edges of the board.

Figure 13:
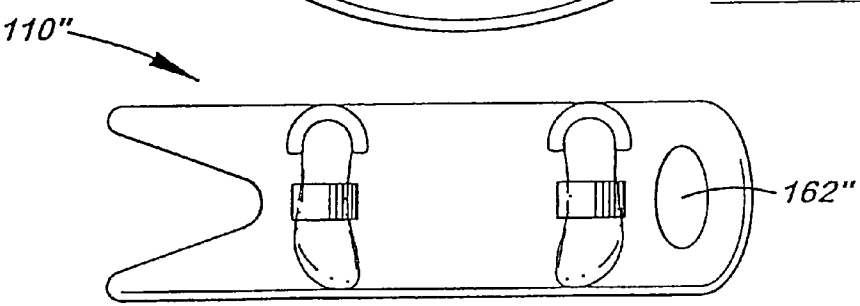
FIG. 13 is a top plan view of another embodiment of the invention.

FIG. 13 illustrates a "finned" footboard 110" according to the invention. One end is generally rounded and has an aperture 162". The other end has two "fins" that create an interesting and fun effect and look for the user.

To use the invented footboard of the shapes shown or many other shapes, the foot boarder preferably removes his/her shoes, climbs on the trampoline and puts on protective gear such as a helmet and mouth guard. Bare or stocking feet are placed in the "stirrups" comprising the strap system and heel rest or other connection system. The invented footboard device may be used on many different jumping and play devices as long as proper safety precautions are taken. For example, a ground-based, water-based, frame or air suspending trampoline may be used. A portable inflated kid's jumping room (such as "KidZone™", not shown) may be used, preferably for one child at a time. Children may even enjoy jumping of the invented device in the grass or on mats in a supervised gymnastics center. The invented device is preferably not used on hard surfaces, sand or snow for safety reasons. However, this device can be used in association with water, in activities such as jumping off of docks, water jumps and other water activities. In the preferred embodiment the board is buoyant. Therefore, the term "trampoline" herein is not intended to limit the device to being used with a particular jumping structure, but may be used with a resilient fabric, a springboard, inflated or other structure. Most preferably, ground trampolines, and therefore this device, should be used with safety fences (screens or netting) or other guards that surround the trampoline and prevent a user from falling or flying off of the trampoline to the ground or other hard surface.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

I claim:

1. A footboard for use on a jumping device, the footboard comprising:

a body, said body is formed of a continuous piece of high density, closed cell foam, said body having a top surface and a generally flat bottom surface defining a thickness there-between, wherein said thickness is 1.0 to 3.0 inches, said top surface defining at least one elongated recessed portion configured to receive a user's foot; and a connection system configured to hold at least a portion of said user's foot within said elongated recessed portion, said connection system comprising:

at least one strap attaching to said body, said strap configured to extend across said recessed portion, said strap for holding said user's foot within said recessed portion, and a heel rest upending from said top surface of said body adjacent a portion of said recessed portion, said heel rest having a height of 1 to 5 inches, said heel rest comprising high density closed cell foam, said heel rest configured for supporting a user's heel.

2. The footboard of claim 1, wherein said body having a body length defined between a body first end and a body second end, said body length defining a body length axis, said elongated recessed portion having a recessed portion length extending between a recessed portion first end and a recessed portion second end, wherein said recessed portion length defining a recessed portion axis, and wherein said recessed portion oriented so that said body length axis is generally perpendicular to said recessed portion axis.

3. The footboard of claim 1, wherein said body is covered by a covering.

4. The footboard of claim 1, wherein said foam is cross-linked polyethylene foam.

5. The footboard of claim 4, wherein said cross-linked polyethylene foam has a foam density between 5 and 15 pounds per cubic foot.

6. The footboard of claim 5, wherein said foam has a 25% load compression quality between 5 and 25 pounds per square inch.

7. The footboard of claim 1, wherein said strap is an adjustable strap.

8. The footboard of claim 7, wherein said adjustable strap does not extend through the bottom of said body.

9. The footboard of claim 1, wherein said body has an outer perimeter, and at least one handgrip positioned near said outer perimeter, wherein said handgrip is an aperture defined within said footboard, said aperture extending through said body.

10. The footboard of claim 1, wherein said body has a first end opposite a second end and an outer perimeter, said body having at least two handgrips positioned near said outer perimeter, said handgrips comprising apertures defined through said footboard, one of said apertures extending through said body adjacent said first end, and one of said apertures extending through said body adjacent said second end.

11. A footboard for use on a jumping device, the footboard comprising:

a body, said body comprising a solid and continuous piece of cross-linked polyethylene foam having a foam density between 5 and 15 pounds per cubic foot and a 25% load compression quality between 5 and 25 pounds per square inch, said body having a top surface and a generally flat bottom surface defining a thickness there-between, wherein said thickness is 1.0 to 3.0 inches, said top surface defining at least one recessed portion configured to receive a user's foot; and a connection system configured to hold at least a portion of said user's foot within said recessed portion, said connection system comprising at least one adjustable strap attaching to said body, said adjustable strap configured to extend across a user's foot and hold said user's foot within said recessed portion, said connection system further comprising a heel rest upending from said top surface of said body, said heel rest configured for supporting a user's heel.

12. The footboard of claim 11, wherein said body is covered by a covering.

13. The footboard of claim 11, wherein said body has an outer perimeter, and at least one handgrip positioned near said outer perimeter, wherein said handgrip is an aperture defined within said footboard, said aperture extending through said body.

14. The footboard of claim 11, wherein said body has a first end opposite a second end and an outer perimeter, said body having at least two handgrips positioned near said outer perimeter, said handgrips comprising apertures defined through said footboard, one of said apertures extending through said body adjacent said first end, and one of said apertures extending through said body adjacent said second end.

15. The footboard of claim 11, wherein said body having a body length defined between a body first end and a body second end, said body length defining a body length axis, said elongated recessed portion having a recessed portion length extending between a recessed portion first end and a recessed portion second end, wherein said recessed portion length defining a recessed portion axis, and wherein said recessed portion oriented so that said body length axis is generally perpendicular to said recessed portion axis.

16. A footboard for use on a jumping device, the footboard comprising:

a body, said body comprising a solid and continuous piece of cross-linked polyethylene foam, said body having a top surface and a generally flat bottom surface defining a thickness there-between, wherein said thickness is 1.0 to 3.0 inches, said top surface defining first and second recessed portions configured to receive a user's feet, wherein said body has a first end opposite a second end and an outer perimeter, said body having at least two handgrips positioned near said outer perimeter, said handgrips comprising apertures defined through said footboard, one of said apertures extending through said body adjacent said first end, and one of said apertures extending through said body adjacent said second end, said body having a body length defined between a body first end and a body second end, said body length defining a body length axis, said elongated recessed portion having a recessed portion length extending between a recessed portion first end and a recessed portion second end, wherein said recessed portion length defining a recessed portion axis, and wherein said recessed portion oriented so that said body length axis is generally perpendicular to said recessed portion axis; and a connection system configured to hold at least a portion of each of said user's feet within said recessed portions, said connection system comprising at least one adjustable first straps attaching to said body, and at least one adjustable second strap attaching to said body, said adjustable first strap configured to extend across a user's first foot and hold said user's first foot within said first recessed portion, said adjustable second strap configured to extend across a user's second foot and hold said user's second foot within said second recessed portion, said connection system further comprising first and second heel rests upending from said top surface of said body respectively adjacent said first recessed portion and said second recessed portion.

17. The footboard of claim 16, wherein said cross-linked polyethylene foam has a foam density between 5 and 15 pounds per cubic foot.

18. The footboard of claim 17, wherein said foam has a 25% load compression quality between 5 and 25 pounds per square inch.

19. The footboard of claim 16, wherein said body is covered by a covering.

* * * * *